United States Patent [19]

Shrode

[11] 4,384,376

[45] May 24, 1983

[54] SHOWER DOOR ASSEMBLY

[76] Inventor: June O. Shrode, 22112 Wood Island La., Huntington Beach, Calif. 92646

[21] Appl. No.: 287,419

[22] Filed: Jul. 27, 1981

[51] Int. Cl.[3] ..... A47K 3/22

[52] U.S. Cl. ..... 4/607; 4/605; 4/614; 4/596; 49/169

[58] Field of Search ..... 4/607, 608, 610, 612, 4/614, 596, 597, 599, 600, 605; 49/169, 170, 171

[56] References Cited

U.S. PATENT DOCUMENTS

| | | | |
|---|---|---|---|
| 1,388,091 | 8/1921 | Bresnahan | 49/169 X |
| 1,392,580 | 10/1921 | Landau | 49/169 X |
| 1,721,223 | 7/1929 | Kern | 49/169 X |
| 2,611,933 | 9/1952 | Comfort | 49/169 X |
| 4,127,967 | 12/1978 | Franzl | 49/171 |

*Primary Examiner*—Henry K. Artis

*Attorney, Agent, or Firm*—Edward E. Roberts

[57] ABSTRACT

A shower door assembly having a panel with an opening therethrough and a moveable closure member in co-acting relation with the opening, the opening being located at the level of the water faucets for providing access to the faucets with the door closed.

9 Claims, 5 Drawing Figures

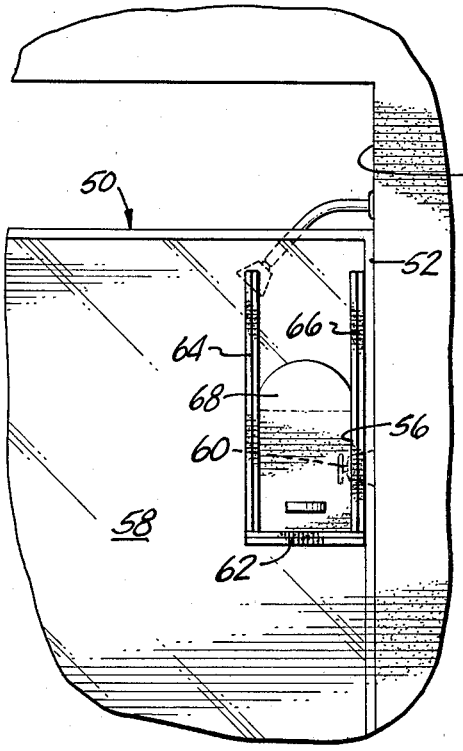
FIG. 4
FIG. 5
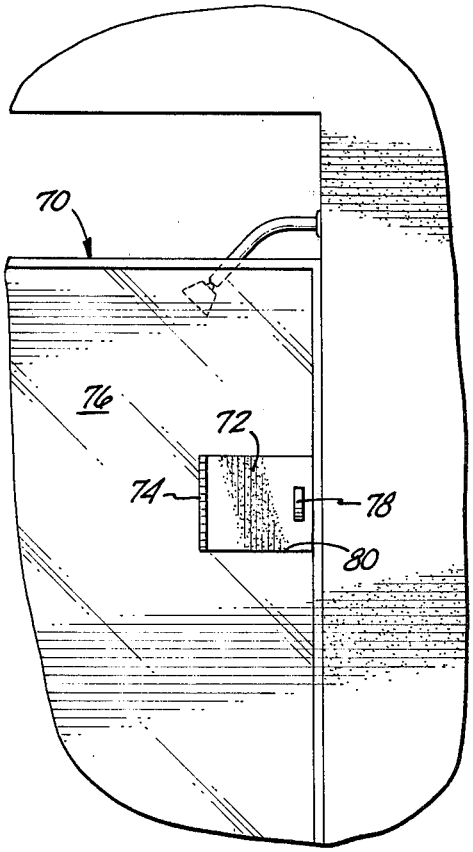

SHOWER DOOR ASSEMBLY

BACKGROUND OF THE INVENTION

The background of the invention will be discussed in two parts:

1. Field of the Invention

This invention relates to shower door assemblies, and more particularly to a shower door assembly for permitting access to the water faucets.

2. Description of the Prior Art

When bathing by use of a shower, normally, the bather adjusts the shower faucet control to achieve a desired temperature of water being dispensed, this operation being performed prior to placing ones body in the shower stream. In conventional shower or shower and tub installations, the controls or faucets are normally positioned on the wall, usually immediately below the shower head. Shower installations may vary with some shower stalls simply having a hinged door, of glass or fibreglass construction, while other larger shower stalls will have a pair of sliding shower doors. Sliding doors are likewise normally found in combined tub and shower enclosures with the sliding door assembly resting on the upper ridge of the tub. In any event, while attempting to adjust the controls to achieve the desired water temperature, the door to the stall must be opened. With the door thus opened, and some part of the body intruding into the shower stream, water impacting on the body is normally discharged outside the enclosure which oftentimes, in addition to the mess, causes a hazardous situation where one can slip and fall due to the water on the floor covering, which may be tile or linoleum or the like.

With the first advent of showers, shower curtains were normally employed such as shown and described in U.S. Pat. Nos. 1,545,093 and 1,898,233. In the shower curtains of each of these patents, the shower head is disposed for discharging the shower stream downwardly rather than at an angle and the shower curtain is suspended to provide a cylindrical surrounding for the bather. With the bather already within the enclosure, the bather could then adjust the shower controls outside the enclosure by reaching through openings provided in the curtain material. While these devices had a degree of utility, the bather was already in the shower stream the temperature of which was being varied or controlled.

With the advent of built-in tubs, Landau attempted to provide a partial shower enclosure in a combination tub/shower assembly in U.S. Pat. No. 1,392,580. In Landau when using the shower, with the door of the shower-bath cabinet opened, one had to be within the shower stream to be able to adjust the faucets.

Shower door assemblies are shown and described in U.S. Pat. No. 2,741,778 issued Apr. 17, 1956 to Dietrich and U.S. Pat. No. 2,851,695 issued Sept. 16, 1958 to the same inventor. The first patent illustrates a shower door stall with a hinged door while the second illustrates a shower enclosure having sliding doors. In both devices, the primary purpose is to provide an auxiliary cabinet for retaining drying means such as towels on the exterior of the shower stall in a dry condition while permitting access from the interior after turning off the shower. Although these patents were uncovered in a search, neither device is configured for permitting access to the shower controls from the outside of the shower stall.

It is an object of the present invention to provide a new and improved shower door assembly.

It is another object of the invention to provide a new and improved shower door assembly having closure means in proximate relation to the water faucets for adjusting the water temperature prior to entering the shower stall.

SUMMARY OF THE INVENTION

The foregoing and other objects of the invention are accomplished by providing a new and improved shower door assembly for a shower stall having wall-mounted water faucets, the door assembly including an opening for permitting access to the water faucets from the exterior of the door. The door is provided with closure means in the form of a sliding or hinged panel.

Other objects, features and advantages of the invention will become apparent from a reading of the specification when taken in conjunction with the drawings, in which, like reference numerals refer to like elements in the several views.

BRIEF DESCRIPTION OF THE DRAWINGS

FIG. 4 is a partial front view illustrating an alternate embodiment of the shower door assembly; and FIG. 5 is a partial front view of a third embodiment of the shower door assembly.

DESCRIPTION OF THE PREFERRED EMBODIMENT

Figure 1:
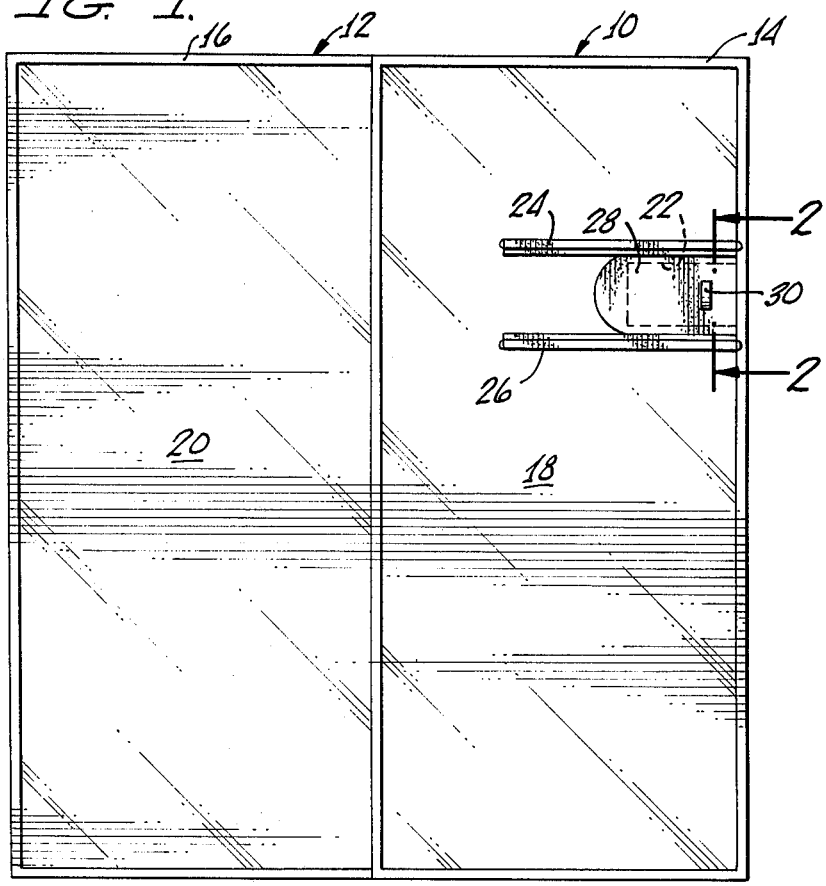
FIG. 1 is a front view of a sliding shower door assembly having a sliding panel according to the invention.

Referring now to the drawings and particularly to FIG. 1 there is shown a shower door assembly of the type which includes a pair of sliding shower doors 10 and 12 configured for sliding on a track (not shown), with each door being slidable relative to the other in close parallel relation. As shown in FIG. 1, the door 10 is the "outer" shower door, that is the shower door nearest the outside of the shower enclosure, while the door 12 is the "inner" door, that is the door nearest the shower stall. Sliding shower door assemblies may be employed in bathing enclosures devoted strictly to showers, or may be mounted on the upper rim of a tub in a combination tub/shower enclosure. In either event, each of the doors 10 and 12 is provided with a peripheral generally rectangular metallic frame 14 and 16 respectively, with the frames 14 and 16 receiving therein generally rectangular panels 18 and 20 of glass or fibreglass. In accordance with the invention, the outer shower door 10 is provided with an opening 22 formed in the window panel 18 thereof, the height of the opening 22 being at a level generally consistent with the level of water faucets (not shown) within the shower/bath enclosure. Mounted on the exterior of the window panel 18 are first and second track members 24 and 26, suitably secured to the window panel 18. The track members 24 and 26 may be of metal or plastic and may be secured to the window panel 18 by suitable means such as screws or adhesive bonding. Received within the opposing track members 24 and 26 is a suitable closure means such as a sliding sub-panel 28 suitably provided with a handle 30 for sliding the sub-panel 30 horizontally as indicated by the double ended arrow thereon for selectively covering and uncovering the opening 22.

Figure 2:
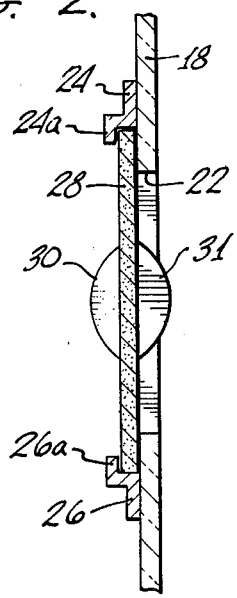
FIG. 2 is a cross-sectional view of the sliding panel assembly of FIG. 1 as viewed generally along line 2—2 thereof.

As illustrated in FIGS. 1 and 2, the track numbers 24 and 26 are provided with lip portions 24*a* and 26*a* ascending toward each other in a common plane for slidably receiving the sub-panel 28 therein. As shown in FIG. 2, two handles 30 and 31 may be provided, with handle 30 on the exterior of the sub-panel 28 and handle 31 on the interior, with both handles being generally similar with handle 31 additionally serving as a "stop" when the sub-panel 28 is moved to the left by reference to FIG. 1 for permitting access through the opening 22 to the water faucets.

In FIG. 1, the track members 24 and 26 extend generally parallel to the upper portion of the frame 14, that is, in a horizontal direction. Additionally, the track members 24 and 26 extend only partially across the width of the window panel 18.

Figure 3:
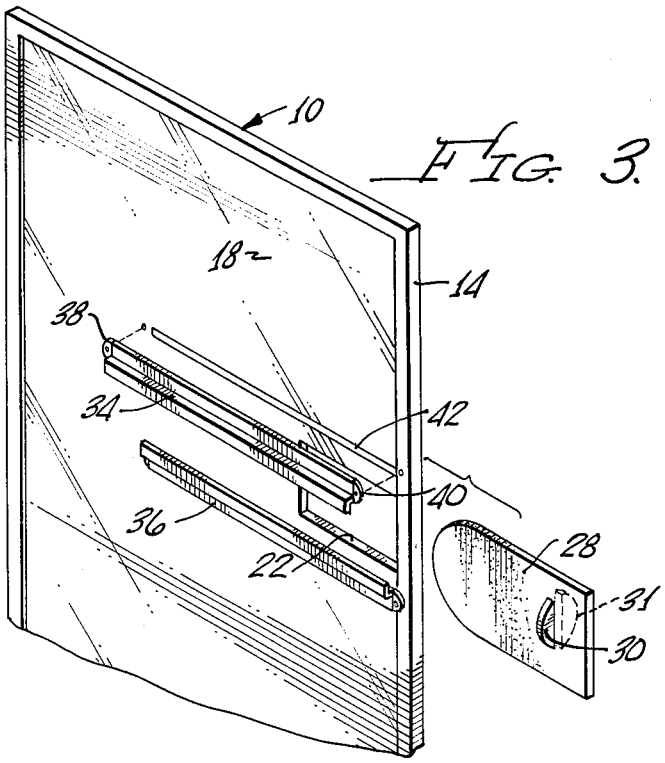
FIG. 3 is an exploded prospective view of a modified shower door assembly.

Referring now to FIG. 3, the opening 22 in the window panel 18 is depicted as being rectangular, but the opening 22 may take any convenient form depending upon the material utilized for the window panel 18. For example, if a window panel 18 is made of glass, a rectangular opening 22 may be more readily fabricated. To provide additional structural rigidity to the window panel 18 with the opening 22 cut therein, tract members 34 and 36 may be used in lieu of track members 24 and 26. The track members 34 and 36 are configured for extending between the vertical metal portions of the frame 14 for securing thereto. The opposing ends of each track member 34 and 36 may be provided with lugs, such as lugs 38 and 40 on member 34, with the lugs 38 and 40 having openings therein for passage throughthrough of suitable fastening means such as sheet metal screws (not shown).

Additionally, to promote a good bond between the adjacent surface of the track member 34 and the window panel 18, a suitable double-sided adhesive strip 42 may be utilized to provide adherents between the flange of track member 34 and the adjacent window panel 18. With this modification the track member 36 may be readily fitted to the door 10 below the opening 22, the door 28 then placed thereon, and the upper track member 34 then secured to the door 10.

Referring now to FIG. 4, an alternate embodiment of shower door assembly is illustrated. The shower door 50 may be hinged or slidable, but in either event, one vertical edge of the frame 52 thereof butts against the wall 54 of the shower enclosure. In this embodiment, the opening 56 of the window panel 58 is again at the level of a shower faucet 60. Secured to the window panel 58 adjacent the bottom of opening 56 is a stop member 62 with the track members 64 and 66 extending vertically in parallel relation for receiving a vertically sliding sub-panel 68 therein. The tracks 64 and 66 may be configured similarly to the track members 24 and 26 previously described, and similarly, the sub-panel 68 may be identically configured to the sub-panel 28 previously described. In this embodiment it would be preferable to provide a slight frictional engagement between the sliding sub-panel 68 and the track members 64 and 66 rather than have a loose fit.

Referring now to FIG. 5, an alternate closure means is depicted for a shower door assembly 70 wherein a hinged door 72 is provided, the hinged door 72 having a vertically extending hinge 74 suitably coupled to the window panel 76 with a handle 78 secured adjacent the opposite side of the door 72 for permitting opening and closing of the door 72. With this configuration, the hinged door 72 may conveniently be formed of the removed piece of the window panel 76 for fitting within the opening 80 in a flush relation with the window panel 76. The end 74 may be conveniently formed of metal suitably fastened to the panel 76 and or 72 or may be formed of plastic material.

In any event where the closure means is on a shower door which forms part of a sliding door arrangement, the closure means is preferably located on the outer shower door, that is the door facing away from the shower stall, for permitting relative sliding movement of the two doors on a non-interfering basis. Further, it is understood that although the drawings depict the outer shower door opening to the left, that the outer shower door could just as well open to the right in the manner taught herein.

While there has been shown and described a preferred embodiment, it is to be understood that various other adaptations and modifications may be made within the spirit and scope of the invention.

I claim:

1. In a shower door assembly for enclosing a bathing area having a first wall with spaced second and third walls perpendicular thereto, one of said second and third walls having a shower head and wall-mounted shower control faucets, the combination comprising:

shower door means extending substantially between said second and third walls generally parallel to said first wall and having a generally rigid movable door panel for providing bodily entry to the bathing area while substantially preventing discharge of water in the area external thereto with said panel closed;

an opening in said panel at a level for providing access to the faucets; and closure means moveably coupled to said shower door panel for providing selective manual access through said opening with said door panel in its closed position.

2. The combinations according to claim 1 wherein said enclosure means include first and second track members mounted to said panel in generally parallel relation on opposite side of said openings and a closure member slidably received within said track members.

3. The combination according to claim 2 wherein said first and second track members are positioned generally horizontally.

4. The combination according to claim 2 wherein said first and second track members are positioned generally vertically.

5. The combination according to claim 3 wherein the closure member further includes handle means.

6. The combination according to claim 4 wherein said closure member further includes handle means.

7. The combination according to claim 1 wherein said closure means includes door means hingedly coupled to said panel for substantially closing said opening.

8. The combination according to claim 7 wherein said door means includes handle means.

9. The combination according to claim 2 wherein said shower door means includes a generally rectangular metallic frame and said first and second track members extend generally horizontally and are secured to said metallic frame.

* * * * *